US009807828B2

(12) United States Patent
Lee et al.

(10) Patent No.: US 9,807,828 B2
(45) Date of Patent: Oct. 31, 2017

(54) ALTERNATING CURRENT-DRIVEN LIGHT EMITTING ELEMENT LIGHTING APPARATUS

(71) Applicant: Seoul Semiconductor Co., Ltd., Ansan-si (KR)

(72) Inventors: Hyung Jin Lee, Ansan-si (KR); Hyun Gu Kang, Ansan-si (KR); Sang Wook Han, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 0 days.

(21) Appl. No.: 15/438,737

(22) Filed: Feb. 21, 2017

(65) Prior Publication Data

US 2017/0164435 A1 Jun. 8, 2017

Related U.S. Application Data

(63) Continuation-in-part of application No. 15/317,737, filed as application No. PCT/KR2015/005606 on Jun. 4, 2015.

(30) Foreign Application Priority Data

Jun. 12, 2014 (KR) ..... 10-2014-0071474

(51) Int. Cl.
*H05B 41/14* (2006.01)
*H05B 33/08* (2006.01)

(52) U.S. Cl.
CPC ..... *H05B 33/0809* (2013.01); *H05B 33/0845* (2013.01)

(58) Field of Classification Search
CPC .... H05B 41/34; H05B 33/0803; H05B 39/09; H05B 41/28; H05B 33/0809;
(Continued)

(56) References Cited

U.S. PATENT DOCUMENTS

2012/0098505 A1 4/2012 Irissou et al.
2012/0206062 A1* 8/2012 Riesebosch ..... H05B 33/0848 315/291

(Continued)

FOREIGN PATENT DOCUMENTS

KR 10-2013-0091456 8/2013
WO 2013/183891 12/2013
WO 2014/073911 5/2014

OTHER PUBLICATIONS

International Search Report dated Aug. 31, 2015, in International Application No. PCT/KR2015/005606.

(Continued)

*Primary Examiner* — Minh D A
(74) *Attorney, Agent, or Firm* — H.C. Park & Associates, PLC

(57) ABSTRACT

An LED lighting apparatus according to exemplary embodiments includes a rectification circuit configured to rectify a modulated AC voltage to generate a drive voltage, an LED driving module connected to a plurality of LED groups and configured to apply a drive current to at least one of the plurality of LED groups according to a level of the drive voltage, and a dimming level detector configured to detect a dimming level corresponding to the drive voltage. The LED driving module is configured to compare the detected dimming level to a reference value and block the drive current based on a result of the comparison.

14 Claims, 9 Drawing Sheets

(58) Field of Classification Search
CPC ..... H05B 41/295; H05B 1/2827; H05B 41/3925; H05B 33/0815; H05B 33/0818; H05B 41/2828; H05B 41/3921; H05B 41/3927; H05B 37/029; H05B 37/0254; H05B 33/0827; Y02B 20/202
USPC ..... 315/200 R
See application file for complete search history.

(56) References Cited

U.S. PATENT DOCUMENTS

| | | | | |
|---|---|---|---|---|
| 2013/0049631 | A1 | 2/2013 | Riesebosch | |
| 2013/0293139 | A1* | 11/2013 | Sadwick ..... | H05B 37/02 315/224 |

OTHER PUBLICATIONS

Written Opinion dated Aug. 31, 2015, in International Application No. PCT/KR2015/005606.

* cited by examiner

ALTERNATING CURRENT-DRIVEN LIGHT EMITTING ELEMENT LIGHTING APPARATUS

CROSS-REFERENCE TO RELATED APPLICATIONS

This application is a Continuation-in-Part of U.S. patent application Ser. No. 15/317,737, filed on Dec. 9, 2016, which is the National Stage entry of International Patent Application No. PCT/KR2015/005606, filed on Jun. 4, 2015, and claims priority from and the benefit of Korean Patent Application No. 10-2014-0071474, filed on Jun. 12, 2014, each of which is incorporated by reference for all purposes as if fully set forth herein.

BACKGROUND

Field

Exemplary embodiments of the present disclosure relate to a lighting apparatus using a dimmable alternating current-driven light emitting diode (LED), and more particularly, to an alternating current (AC)-driven LED lighting apparatus which allows dimming control through phase cut control and exhibits idealistic and stable variation of a dimming level over an entire interval of the dimming level using a triode for alternating current (TRIAC) dimmer. In addition, exemplary embodiments of the present disclosure relate to an AC-driven LED lighting apparatus which can improve compatibility of the TRIAC dimmer.

Discussion of the Background

Generally, a light emitting diode (LED) can be driven only by direct current (DC) power due to inherent characteristics thereof. Thus, a lighting apparatus employing such a conventional LED is limited in applicability and requires a separate circuit such as a switching mode power supply (SMPS) when used in domestic settings employing AC 220V power. As a result, the lighting apparatus has problems such as complicated circuit design and high manufacturing costs.

In order to solve such problems, various studies have focused on development of an AC-driven LED lighting apparatus which includes a plurality of light emitting cells connected to each other in series or in parallel and can be driven by AC power.

In order to solve the above problems in the related art, sequential driving of AC-driven LEDs has been suggested. In this sequential driving method, assuming that a lighting apparatus includes three groups of LEDs, under conditions that an input voltage increases over time, a first LED group starts to emit light in a first stage driving interval; a second LED group is connected in series to the first LED group and the first and second LED groups are turned on to emit light in a second stage driving interval in which a drive voltage is higher than the drive voltage in the first stage driving interval; and first to third LED groups are turned on to emit light in a third stage driving interval in which the drive voltage is higher than the drive voltage in the second stage driving interval. In addition, under conditions that the drive voltage decreases over time, first, the third LED group stops light emission in the second stage driving interval, the second LED group stops light emission in the first stage driving interval, and the first LED group finally stops light emission at a drive voltage lower than the drive voltage of the first stage driving interval such that an LED drive voltage approaches the input voltage.

On the other hand, LED dimming control refers to an operation of changing luminescent flux or illuminance (Lux) of an LED lighting apparatus, that is, brightness of a light source, according to voltage applied thereto, and a dimmable light source means a system configured to perform such illuminance control in the lighting apparatus. Such a dimmable system is provided to the LED lighting apparatus in order to reduce power consumption and enables efficient operation of the LED lighting apparatus. Particularly, heat generated during continuous light emission from LEDs causes deterioration in quality and efficiency of a lighting operation. Accordingly, in order to satisfy user demand while reducing power consumption, a dimming function is generally provided to the LED lighting apparatus. Among such LED lighting apparatuses having the dimming function, since a DC-driven LED lighting apparatus is driven by converting AC power into DC power through an SMPS, the DC-driven LED lighting apparatus allows relatively easy dimming and thus can be expected to have a certain degree of dimming control characteristics. However, since a typical AC-driven LED lighting apparatus as described above drives LEDs using only a rectified voltage obtained through rectification of AC voltage, the AC-driven LED lighting apparatus has difficulty realizing the dimming function and securing linearity in dimming control. Particularly, a sequential driving type AC-driven LED lighting apparatus has a problem in that drive voltage becomes unstable due to temporary increase or decrease in drive voltage by internal impedance of an AC power supply line and a dimmer as soon as LEDs are tuned on or turned off for the next operation when the number of LED groups turned on to emit light is changed depending upon the magnitude of the drive voltage (for example, upon change from fourth stage driving to third stage driving, upon change from third stage driving to second stage driving, and the like). That is, a typical AC-driven LED lighting apparatus having the dimming function suffers from irregular variation of luminescent flux in some dimming control intervals instead of enabling variation in the luminescent flux over an entire interval of the dimming level.

The above information disclosed in this Background section is only for enhancement of understanding of the background of the inventive concepts, and, therefore, it may contain information that does not form the prior art that is already known in this country to a person of ordinary skill in the art.

SUMMARY

Exemplary embodiments of the present disclosure are aimed at solving the aforementioned problems in the related art.

Exemplary embodiments of the present disclosure provide an AC-driven LED lighting apparatus which exhibits idealistic dimming characteristics over an entire interval of a dimming level.

Exemplary embodiments of the present disclosure provide an AC-driven LED lighting apparatus which exhibits good dimming characteristics in association with a TRIAC dimmer configured to perform dimming control through phase cut control.

Exemplary embodiments of the present disclosure provide an AC-driven LED lighting apparatus which prevents a flickering phenomenon upon sequential driving of LED groups.

Exemplary embodiments of the present disclosure provide an AC-driven LED lighting apparatus which prevents irregular dimming at a low dimming level.

Additional aspects will be set forth in the detailed description which follows, and, in part, will be apparent from the disclosure, or may be learned by practice of the inventive concepts.

An LED lighting apparatus according to one or more exemplary embodiments of the present disclosure includes a rectification circuit configured to rectify a modulated AC voltage to generate a drive voltage, an LED driving module connected to a plurality of LED groups and configured to apply a drive current to at least one of the plurality of LED groups according to a level of the drive voltage, and a dimming level detector configured to detect a dimming level corresponding to the drive voltage. The LED driving module is configured to compare the detected dimming level to a reference value and block the drive current based on a result of the comparison.

The number of LED groups to which the drive current may be applied varies according to the level of the drive voltage.

A cycle of the drive voltage may have a time period in which all of the plurality of the LED groups are driven when the detected dimming level is equal to or higher than the reference value.

The LED driving module may be configured to block the drive current when the detected dimming level is lower than the reference value.

The dimming level detector may include an integration circuit including a resistor and a capacitor.

The LED driving module may be configured to decrease the drive current as the level of the drive voltage decreases.

The LED driving module may be configured to control the drive current according to the detected dimming level.

The plurality of LED groups may include first to $n^{th}$ LED groups sequentially connected to an input node which receives the drive voltage, wherein n is a positive integer, and the LED driving module may be connected to output terminals of the first to $n^{th}$ LED groups through first to $n^{th}$ nodes, respectively.

The LED driving module may be configured to apply the drive current to $k^{th}$ node selected from the first to $n^{th}$ nodes according to the level of the drive voltage, wherein k is a positive integer equal to or smaller than n, and the drive current may be controlled according to the detected dimming level.

The LED driving module may decrease the driving current as k decreases.

The dimming level detector may be configured to output a dimming phase signal when the drive voltage is higher than a predetermined voltage level, and the dimming phase signal may be provided as the dimming level.

The LED driving module may include a comparator configured to receive a clock signal and count pulses of the clock signal which are toggled while the dimming phase signal is outputted, and the drive current may be blocked based on a number of counted pulses.

The LED driving module may further include an LED current blocking unit configured to block the drive current when the number of counted pulses is less than the reference value.

The LED driving module may further include a converter configured to output a dimming voltage according to the number of counted pulses, and the drive current may be controlled according to the dimming voltage.

According to exemplary embodiments, the AC-driven LED lighting apparatus exhibits smooth dimming characteristics over an entire interval of a dimming level.

In addition, according to exemplary embodiments, the AC-driven LED lighting apparatus exhibits good dimming characteristics in association with a TRIAC dimmer configured to perform dimming control through phase cut control.

Further, according to exemplary embodiments, the AC-driven LED lighting apparatus prevents irregular flickering during sequential driving of LED groups.

Furthermore, according to exemplary embodiments, the AC-driven LED lighting apparatus can perform more efficient dimming control based on a phase cut drive voltage and a drive current for LEDs corresponding to a dimming level.

Furthermore, according to exemplary embodiments, the AC-driven LED lighting apparatus can block a drive current from being supplied to all of first to fourth LED groups at a dimming level less than a preset phase cut reference value, thereby preventing uneven brightness such as flickering. Particularly, the AC-driven LED lighting apparatus can prevent flickering and uneven dimming upon change from the maximum driving interval to other intervals, in which LED groups are turned off one by one (e.g., a time at which a fourth stage driving interval is transited into a third stage driving interval) in a plurality of LED groups configured to be sequentially driven.

Furthermore, according to exemplary embodiments, the AC-driven LED lighting apparatus blocks a drive current from being supplied to all of first to fourth LED groups with reference to a preset phase cut reference value, thereby improving compatibility of a dimmer through improvement in dimming characteristics that vary depending upon a TRIAC dimmer.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concepts, and, together with the description, serve to explain principles of the inventive concepts.

DETAILED DESCRIPTION OF THE ILLUSTRATED EMBODIMENTS

Figure 1:
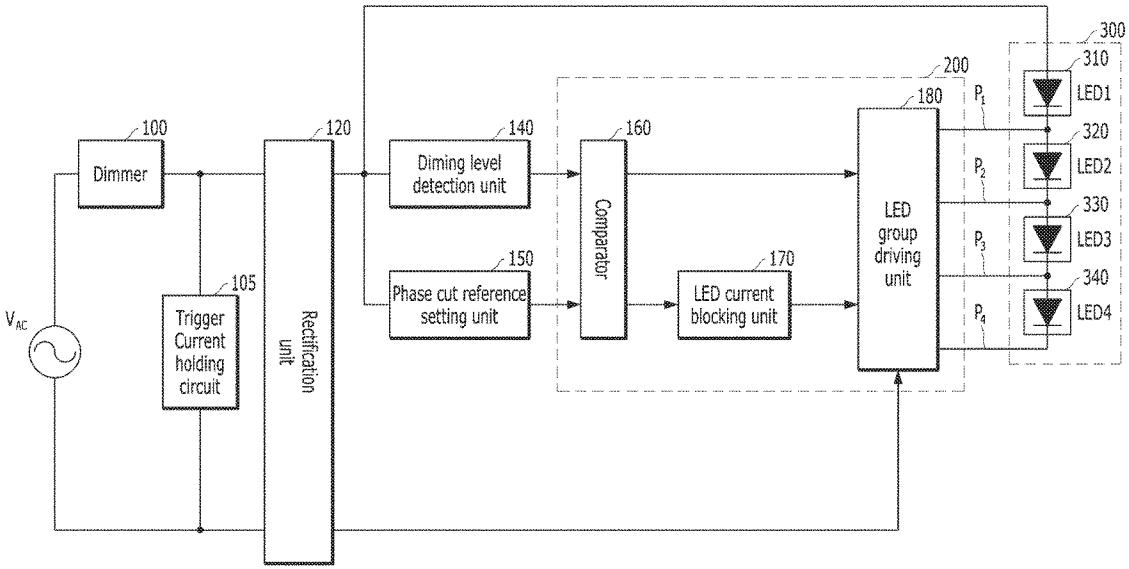
FIG. 1 is a block diagram of an AC-driven LED lighting apparatus according to one exemplary embodiment of the present disclosure.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Herein, the term "LED group" refers to a group of light emitting diodes (or light emitting cells) connected to one another in series/parallel/series-parallel to be operated as a single unit under control of a drive integrated circuit (IC) (that is, to be turned on/off at the same time).

In addition, the term "LED driving module" means a module configured to drive and control a light emitting diode after receiving AC voltage, and although the LED driving module is described with reference to exemplary embodiments in which driving of LEDs are controlled using a rectified voltage, it should be understood that other implementations are also possible and the LED driving module should be comprehensively and broadly interpreted.

Further, the term "first forward voltage level" means a critical voltage level capable of driving a first LED group, the term "second forward voltage level" means a critical voltage level capable of driving a first LED group and a second LED group connected to each other in series, and the term "third forward voltage level" means a critical voltage level capable of driving the first to third LED groups connected to each other in series. Namely, the term "$n^{th}$ forward voltage level" means a critical voltage level capable of driving the first to $n^{th}$ LED groups connected to each other in series. On the other hand, the forward voltage levels of LED groups may be the same or different depending upon the number/characteristics of LEDs constituting each of the LED groups.

Further, the term "sequential driving" means a method of sequentially driving a plurality of LED groups in an LED driving module, which drives light emitting diodes upon receiving an input voltage varying over time, such that the plural LED groups are sequentially turned on to emit light with increasing input voltage and are sequentially turned off with decreasing input voltage.

Further, the term "first stage driving interval" means a time interval in which only the first LED group is turned on to emit light, and the term "second stage driving interval" means a time interval in which only the first LED group and the second LED group are turned on to emit light. Thus, the term "$n^{th}$ stage driving interval" means a time interval in which all of the first to $n^{th}$ LED groups are turned on to emit light and a $(n+1)^{th}$ LED group or more LED groups do not emit light.

Figure 2:
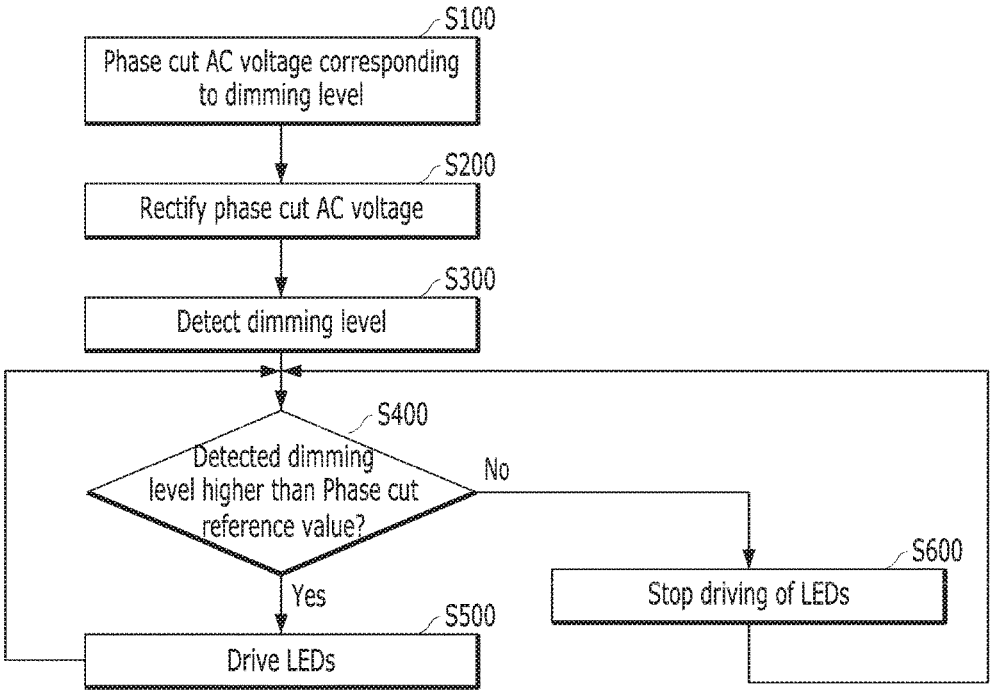
FIG. 2 is a flowchart of a driving method of the AC-driven LED lighting apparatus according to the exemplary embodiment of the present disclosure.

FIG. 1 is a block diagram of an AC-driven LED lighting apparatus according to one exemplary embodiment of the present disclosure and FIG. 2 a flowchart of a driving method of the AC-driven LED lighting apparatus according to the exemplary embodiment of the present disclosure.

Referring to FIG. 1, the AC-driven LED lighting apparatus according to one exemplary embodiment includes a TRIAC dimmer 100, a trigger current holding circuit 105, a rectification unit 120, a dimming level detection unit 140, a phase cut reference setting unit 150, an LED driving module 200, and an LED lighting unit 300.

The TRIAC dimmer 100 receives an AC voltage $V_{AC}$ input from an AC power source and generates a phase cut AC voltage obtained through phase modulation of the input AC voltage $V_{AC}$ corresponding to a dimming level selected by a user. The TRIAC dimmer 100 generates a phase-controlled AC voltage through phase modulation of the AC voltage $V_{AC}$ corresponding to the dimming level selected by a user. The TRIAC dimmer is well known in the art and thus a detailed description thereof will be omitted herein.

The trigger current holding circuit 105 is connected between the TRIAC dimmer 100 and the rectification unit 120, and supplies a TRIAC trigger current to an AC power input or a rectified voltage output, or acts as a dummy load circuit. For example, the trigger current holding circuit 105 may be a bleeder circuit composed of a bleeder capacitor and a bleeder resistor connected in series to the bleeder capacitor. Here, the trigger current holding circuit 105 is not limited to the bleeder circuit and may be one circuit selected from voltage stabilization circuits.

The rectification unit 120 generates a drive voltage through rectification of the phase cut AC voltage and outputs the drive voltage. The rectification unit 120 may be one of various rectification circuits well known in the art, such as a full-wave rectification circuit and a half-wave rectification circuit, without being limited thereto. For example, the rectification unit 120 may be a bridge full-wave rectification circuit composed of four diodes. The drive voltage generated by the rectification unit 120 is output to the dimming level detection unit 140, the phase cut reference setting unit 150, the LED driving modules 200, and the LED lighting unit 300.

The LED lighting unit 300 includes a plurality of LED groups. The plural LED groups are sequentially turned on or off. Although the LED lighting unit 300 is described as including first to fourth groups 310 to 340, it should be understood that other implementations are also possible and the number of LED groups can be changed in various ways. The first to fourth LED groups 310 to 340 may have different forward voltage levels, respectively. For example, when each of the first to fourth LED groups 310 to 340 includes a different number of LEDs, the first to fourth LED groups 310 to 340 have different forward voltage levels.

The dimming level detection unit 140 detects a current dimming level selected by a user based on the drive voltage supplied from the rectification unit 120 and outputs a dimming level signal corresponding to the detected dimming level to the LED driving module 200. More specifically, the dimming level detection unit 140 according to the exemplary embodiment can detect the dimming level by averaging drive voltage levels that change over time. Since the TRIAC dimmer 100 is configured to modulate a phase of the AC voltage $V_{AC}$ corresponding to the dimming level selected by a user, the dimming level detection unit 140 can detect the dimming level by averaging the drive voltage levels. The dimming level signal may be a DC signal having a constant voltage value. For example, for a dimming level of 100%, the dimming level signal may be 2V; for a dimming level of 90%, the dimming level signal may be 1.8V; and for a dimming level of 50%, the dimming level signal may be 1V. The dimming level signal corresponding to the dimming level may be changed using various circuit designs. For example, an resistor-capacitor (RC) integration circuit may be used.

The phase cut reference setting unit 150 has a phase cut reference value. The phase cut reference value may be preset by a user or changed, as needed. That is, the phase cut reference setting unit 150 is determined by a user and the phase cut reference value may be set to an interval in which failure such as flickering occurs or within the shortest driving interval in which all of the first to fourth LED groups 310 to 340 are driven at a low dimming level. For example, the phase cut reference value may be set within an interval in which all of the first to fourth LED groups 310 to 340 are driven.

The LED driving module 200 includes a comparator 160, an LED current blocking unit 170, and the LED group driving unit 180.

The comparator 160 is configured to compare the dimming level signal of the dimming level detection unit 140 with the phase cut reference value of the phase cut reference setting unit 150.

The LED current blocking unit 170 is configured to stop driving of the first to fourth LED groups 310 to 340 when the dimming level signal of the dimming level detection unit 140 is lower than the phase cut reference value of the phase cut reference setting unit 150. The LED current blocking unit 170 outputs a stop signal to the LED group driving unit 180. Here, the LED current blocking unit 170 may be included in the comparator 160.

The LED group driving unit 180 control sequential driving of the first to fourth LED groups 310 to 340 according to the voltage level of the drive voltage input from the rectification unit 120. That is, the AC-driven LED lighting apparatus has first to seventh intervals in which the first to fourth LED groups 310 to 340 are sequentially driven. The first interval is defined as an interval in which the voltage level of the drive voltage input from the rectification unit 120 is a value between a first forward voltage level and a second forward voltage level, and, in the first interval, only a first current path $P_1$ is connected to turn on the first LED group 310 to emit light. In addition, the second is defined as an interval in which the voltage level of the drive voltage input from the rectification unit 120 is a value between the second forward voltage level and a third forward voltage level, and, in the second interval, the second current path $P_2$ is connected to turn on the first and second LED groups 310, 320 to emit light. Further, the third interval is defined as an interval in which the voltage level of the drive voltage input from the rectification unit 120 is a value between the third forward voltage level and a fourth forward voltage level, and, in the third interval, a third current path $P_3$ is connected to turn on the first to third LED groups 310 to 330 to emit light. Further, the fourth interval is defined as an interval in which the voltage level of the drive voltage input from the rectification unit 120 is the fourth forward voltage level, and, in the fourth interval, a fourth current path $P_4$ is connected to turn on the first to fourth LED groups 310 to 340 to emit light. Further, the fifth interval is defined as an interval in which the voltage level of the drive voltage input from the rectification unit 120 is a value between the fourth forward voltage level and the third forward voltage level, and, in the fifth interval, the third current path P3 is connected to turn on the first to third LED groups 310 to 330 to emit light. Further, the sixth interval is defined as an interval in which the voltage level of the drive voltage input from the rectification unit 120 is a value between the third forward voltage level and the second forward voltage level, and, in the sixth interval, the second current path P2 is connected to turn on the first and second LED groups 310, 320 to emit light. Further, the seventh interval is defined as an interval in which the voltage level of the drive voltage input from the rectification unit 120 is a value between the second forward voltage level and the first forward voltage level, and, in the seventh interval, only the first current path $P_1$ is connected to turn on the first LED group 310 to emit light. The first and seventh intervals may be defined as a first stage driving interval, the second and sixth intervals may be defined as a second stage driving interval, the third and fifth intervals may be defined as a third stage driving interval, and the fourth interval may be defined as a fourth stage driving interval.

Although not shown in the drawings, the LED driving module 200 further includes a drive current controller (see, e.g., 511 to 541 in FIG. 5) configured to control the magnitude of a drive current for the first to fourth LED groups 310 to 340 corresponding to a dimming level. The drive current controller may be included in the LED group driving unit 180. The drive current controller may include a drive current register which is set to be proportional to the dimming level. The drive current controller may include a drive current resistor preset corresponding to the dimming level.

Referring to FIG. 1 and FIG. 2, in the driving method of the AC-driven LED lighting apparatus according to this exemplary embodiment, a phase cut AC voltage corresponding to a dimming level selected by a user is generated by the TRIAC dimmer 100 (S100).

The rectification unit 120 generates a drive voltage by rectifying the phase cut AC voltage and outputs the drive voltage (S200).

The dimming level detection unit 140 detects a current dimming level selected by a user based on the drive voltage supplied from the rectification unit 120 and outputs a dimming level signal corresponding to the detected dimming level to the LED driving module 200 (S300).

The LED driving module 200 compares the dimming level signal with a phase cut reference value (S400). The LED driving module 200 includes the comparator 160 configured to compare the dimming level signal with the phase cut reference value and the LED current blocking unit 170 configured to stop driving of all of the first to fourth LED groups 310 to 340 when the dimming level is less than a preset phase cut reference value.

If the dimming level signal is higher than or equal to the phase cut reference value, the LED driving module 200 supplies a drive current corresponding to the dimming level to one of the first to fourth LED groups 310 to 340 (S500). Here, the comparator 160 compares the dimming level signal with the phase cut reference value during a driving interval of the first to fourth LED groups 310 to 340.

If the dimming level signal is less than the phase cut reference value, the LED driving module 200 blocks the drive current supplied to the first to fourth LED groups 310 to 340 (S600). Here, the comparator 160 compares the dimming level signal with the phase cut reference value during an interval in which driving of the first to fourth LED groups 310 to 340 is stopped. Accordingly, the LED driving module 200 according to this exemplary embodiment can control driving of the first to fourth LED groups 310 to 340 corresponding to the dimming level changing over time by comparing the dimming level signal with the phase cut reference value during the driving interval of the first to fourth LED groups 310 to 340 and the driving stop interval thereof.

According to the exemplary embodiment, when the dimming level is less than the preset phase cut reference value, the AC-driven LED lighting apparatus blocks the drive current from being supplied to all of the first to fourth LED groups 310 to 340, thereby preventing uneven brightness such as flickering. Particularly, the AC-driven LED lighting apparatus can improve flickering and uneven dimming occurring upon change from the maximum driving interval to other intervals, in which LED groups are turned off one by one (e.g., the time at which the operation mode is changed from the fourth stage driving interval into the third stage driving interval) in a plurality of LED groups configured to be sequentially driven.

Further, the AC-driven LED lighting apparatus according to the exemplary embodiment blocks the drive current from being supplied to all of the first to fourth LED groups 310 to 340 with reference to a preset phase cut reference value, thereby improving compatibility of a dimmer through improvement in dimming characteristics that vary depending upon the TRIAC dimmer 100.

Figure 3:
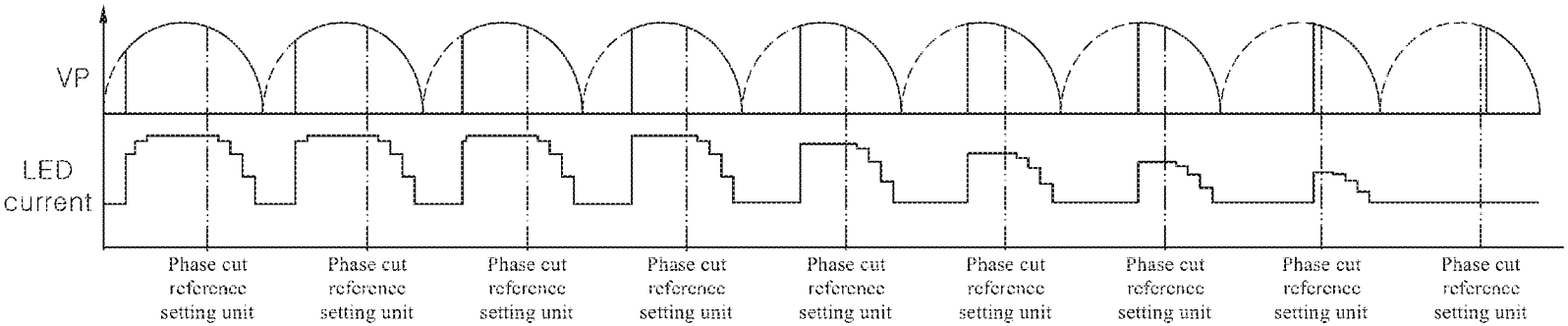
FIG. 3 and FIG. 4 are waveform graphs depicting a relationship between drive voltage and drive current of LEDs depending upon a dimming level.
Figure 4:
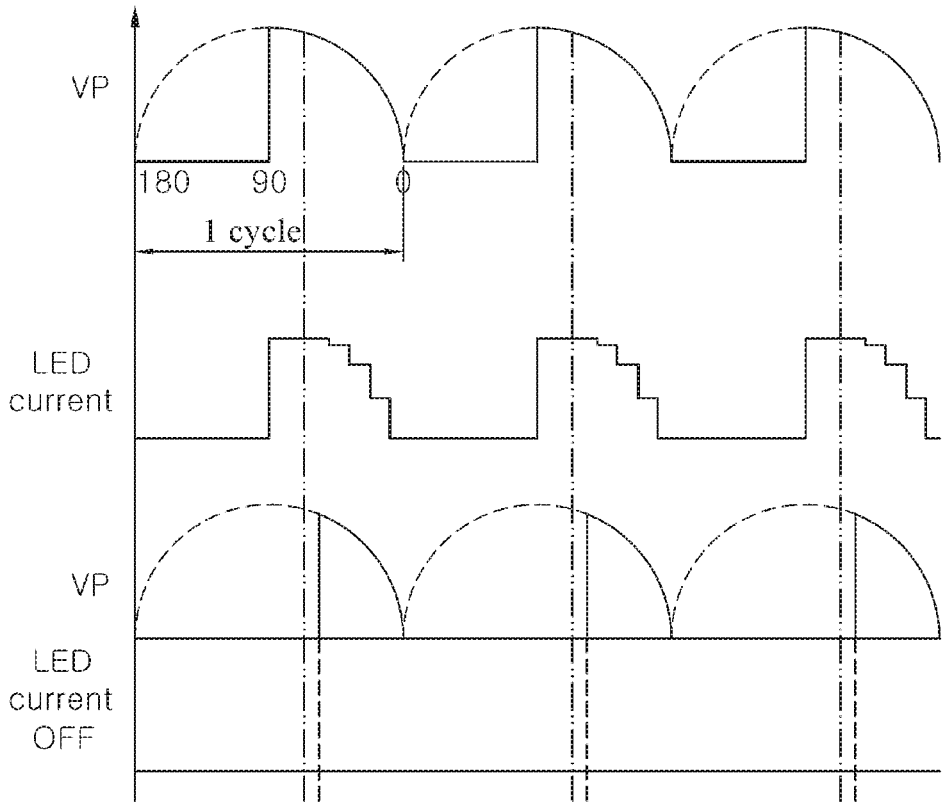

FIG. 3 and FIG. 4 are waveform graphs depicting a relationship between drive voltage and drive current of LEDs depending upon a dimming level.

As shown in FIG. 3 and FIG. 4, the AC-driven LED lighting apparatus according to exemplary embodiments exhibits smooth dimming characteristics over an entire interval of a dimming level by controlling the magnitude of drive current in proportion to a dimming level selected by a user. In addition, the AC-driven LED lighting apparatus according to the exemplary embodiment blocks drive current from being supplied to all of the LED groups at a dimming level less than a preset phase cut reference value, thereby preventing flickering or uneven dimming. For example, the AC-driven LED lighting apparatus according to the exemplary embodiments stops driving of all of the plural LED groups in an interval in which the dimming level is less than the preset phase cut reference value (in an interval in which the dimming level is gradually decreased from a dimming level of the fourth stage driving interval), thereby preventing flickering or uneven dimming. Here, the phase cut reference value may be set to a value between 90 to 0 with reference to one cycle of a phase-cut AC voltage.

Further, the AC-driven LED lighting apparatus according to the exemplary embodiments can improve compatibility of a dimmer by improving dimming characteristics that vary depending upon the TRIAC dimmer 100.

Figure 5:
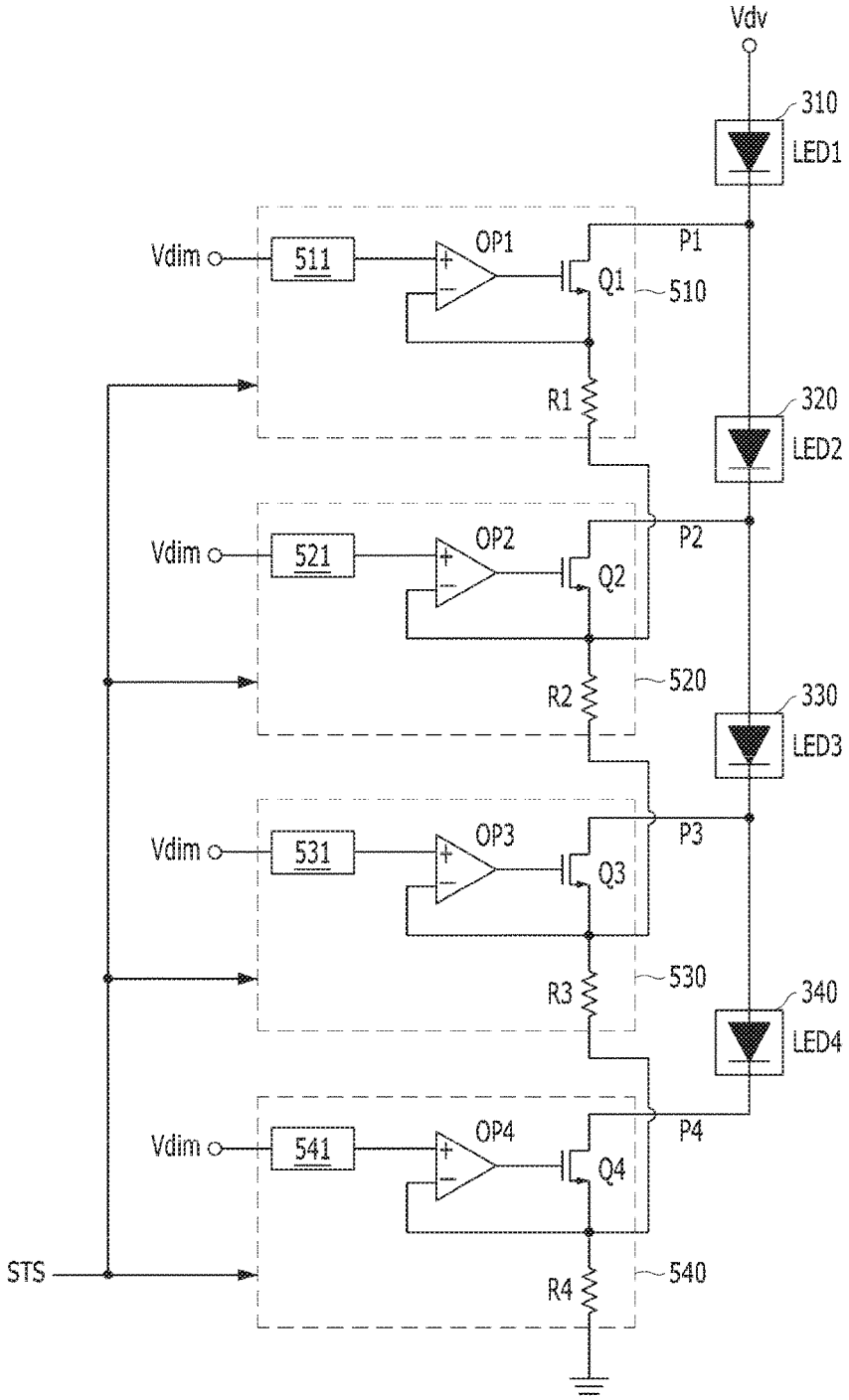
FIG. 5 is a block diagram of the LED group driving unit and the LED lighting unit shown in FIG. 1.

FIG. 5 is a block diagram of the LED group driving unit and the LED lighting unit shown in FIG. 1.

Referring to FIG. 5, the LED group driving unit 180 includes first LED driver 510, second LED driver 520, third LED driver 530, and fourth LED driver 540. The first to fourth LED drivers 510 to 540 control drive currents of the first current path P1, second current path P2, third current path P3, and fourth current path P4, respectively.

At least one of the first to fourth LED drivers 510 to 540 may apply the drive current to a corresponding current path according to the level of the drive voltage Vdv. For example, in the first stage driving interval described with reference to FIG. 1, the first LED driver 510 drives the first LED group 310 by applying the drive current to the first current path P1. In the second stage driving interval, the second LED driver 520 drives the first and second LED groups 310 and 320 by applying the drive current to the second current path P2. In the third stage driving interval, the third LED driver 530 drives the first to third LED groups 310 to 330 by applying the drive current to the third current path P3. In the fourth stage driving interval, the fourth LED driver 540 drives the first to fourth LED groups 310 to 340 by applying the drive current to the fourth current path P4. Referring back to FIG. 3 together with FIG. 5, when a certain dimming level is selected, the drive current applied to the second current path P2 is higher than the first current path P1, the drive current applied to the third current path P3 is higher than the second current path P2, and the drive current applied to the fourth current path P4 is higher than the third current path P3.

Referring again to FIG. 5, the first LED driver 510 includes a first drive current controller 511, a first differential amplifier OP1, a first switch Q1, and a first resistance R1. The non-inverting input terminal of the first differential amplifier OP1 is connected to the output terminal of the first drive current controller 511. The inverting input terminal of the first differential amplifier OP1 is connected to the node between the first switch Q1 and the first resistance R1. The first switch Q1 is turned on or turned off in response to the output signal of the first differential amplifier OP1. The first switch Q1 is connected between the first current path P1 and the first resistance R1. In an exemplary embodiment, the first switch Q1 may employ bipolar junction transistor BJT, field effect transistor FET, and the like, however, exemplary embodiments are not limited thereto. As described in FIG. 5, the first switch Q1 may be P-type MOSFET.

The first drive current controller 511 may be configured as similar to the drive current controller described above. The first drive current controller 511 receives a dimming voltage Vdim, which represents the dimming level, from the dimming level detection unit 140. The first drive current controller 511 may control the drive current applied to the first current path P1 according to the dimming voltage Vdim. The first drive current controller 511 may decrease the drive current applied to the first current path P1 as the dimming voltage Vdim decreases.

The first drive current controller 511 outputs an output voltage, which is determined according to the dimming voltage Vdim, to the non-inverting input terminal of the first differential amplifier OP1. The output node of the first differential amplifier is connected to the gate of the first switch Q1, the inverting input terminal of the first differential amplifier is connected to the source of the first switch Q1. The drive current of the first current path P1 connected to the drain of the first switch Q1 may be controlled to have a level corresponding to the output voltage of the first drive current controller 511. The first drive current controller 511 may control the output voltage to decrease as the dimming voltage Vdim decreases.

Each of the second to fourth LED drivers 520 to 540 may be configured and operated as similar to the first LED driver 510. The second LED driver 520 includes a second drive current controller 521, a second differential amplifier OP2, a second switch Q2, and a second resistance R2, and may control the drive current applied to the second current path P2. The third LED driver 530 includes a third drive current controller 531, a third differential amplifier OP3, a third switch Q3, and a third resistance R3. The fourth LED driver 540 includes a fourth drive current controller 541, a fourth differential amplifier OP4, a fourth switch Q4, and a fourth resistance R4.

In this manner, the drive current of each current path may be controlled based on the dimming level. As described in FIG. 3, the drive current of each current path in each stage driving interval may decrease as the dimming level decreases.

In an exemplary embodiment, the second resistance R2 is connected between the first resistance R1 and the third resistance R3. The third resistance R3 is connected between the second resistance R2 and the fourth resistance R4. The fourth resistance R4 is connected between the third resistance R3 and the ground node. Depending on the first to fourth resistances R1 to R4, at least one of the first to fourth current paths P1 to P4 is selected and the LED driver corresponding to the selected current path may provide the drive current thereto.

The first to fourth LED driver 510 to 540 block the drive currents applied to the first to fourth current paths P1 to P4 in response to a stop signal STS. The driving currents of the first to fourth current paths P1 to P4 may be blocked when the stop signal STS is enabled.

It is understood that the first to fourth LED driver 510 to 540 may block the drive currents by using various manners. For instance, each LED driver may deactivate at least one of the drive current controller and the differential amplifier when the stop signal STS is enabled. For another instance, each LED driver may provide the ground voltage rather than the dimming voltage Vdim when the stop signal STS is enabled.

As described with reference to FIG. 1, the stop signal STS is enabled when the dimming voltage Vdim is lower than the phase cut reference value. Therefore, the drive currents may be blocked when the dimming voltage Vdim is lower than the phase cut reference value. The phase cut reference value may be set such that each cycle of the drive voltage has a time (i.e. the fourth stage driving interval) in which all of the LED groups 310 to 340 are driven when the dimming level Vdim is equal to or higher than the phase cut reference value.

It is assumed that the drive currents are not blocked. The dimming level may be selected low such that the fourth stage driving interval cannot be provided. That is, the dimming level may be selected such that the drive voltage does not have a relatively high voltage level and the time in which all of the LED groups 310 to 340 are driven does not occur. In case where the dimming level is controlled to maintain low in a plurality of the cycles of the drive voltage, the fourth LED group 340 is not driven and remaining LED groups 310 to 330 are driven in a long time. It means that the user can recognize the emitted light is not uniform.

According to the exemplary embodiments of the present disclosure, in order to block the drive currents, the stop signal STS is generated by comparing the dimming voltage Vdim to the phase cut reference value when the dimming level is selected low and the fourth stage driving interval cannot be provided. Accordingly, a phenomenon in which some of the LED groups 310 to 340 are emitted may be prevented.

Figure 6:
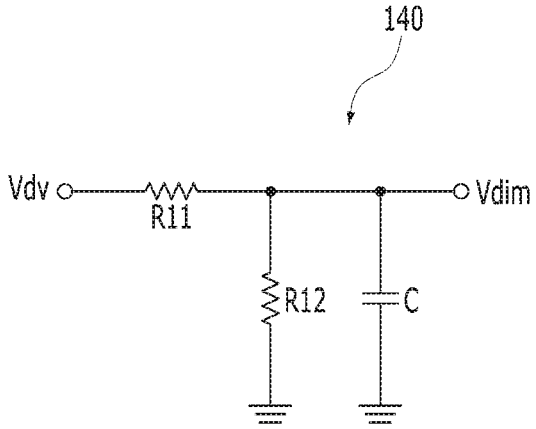
FIG. 6 is a circuit diagram of an exemplary embodiment of the dimming level detection unit in FIG. 1.

FIG. 6 is a circuit diagram of an exemplary embodiment of the dimming level detection unit in FIG. 1.

Referring to FIG. 6, the dimming level detection unit 140 includes first and second resistance R11 and R12, and a capacitor C. The first resistance R11 is connected between a input node receiving the drive voltage Vdv and an output node outputting the dimming voltage Vdim. Each of the second resistance R12 and the capacitor C is connected between the output node outputting the dimming voltage Vdim and the ground node. According to this embodiment, the dimming level detection unit 140 may function as the integration circuit.

Figure 7:
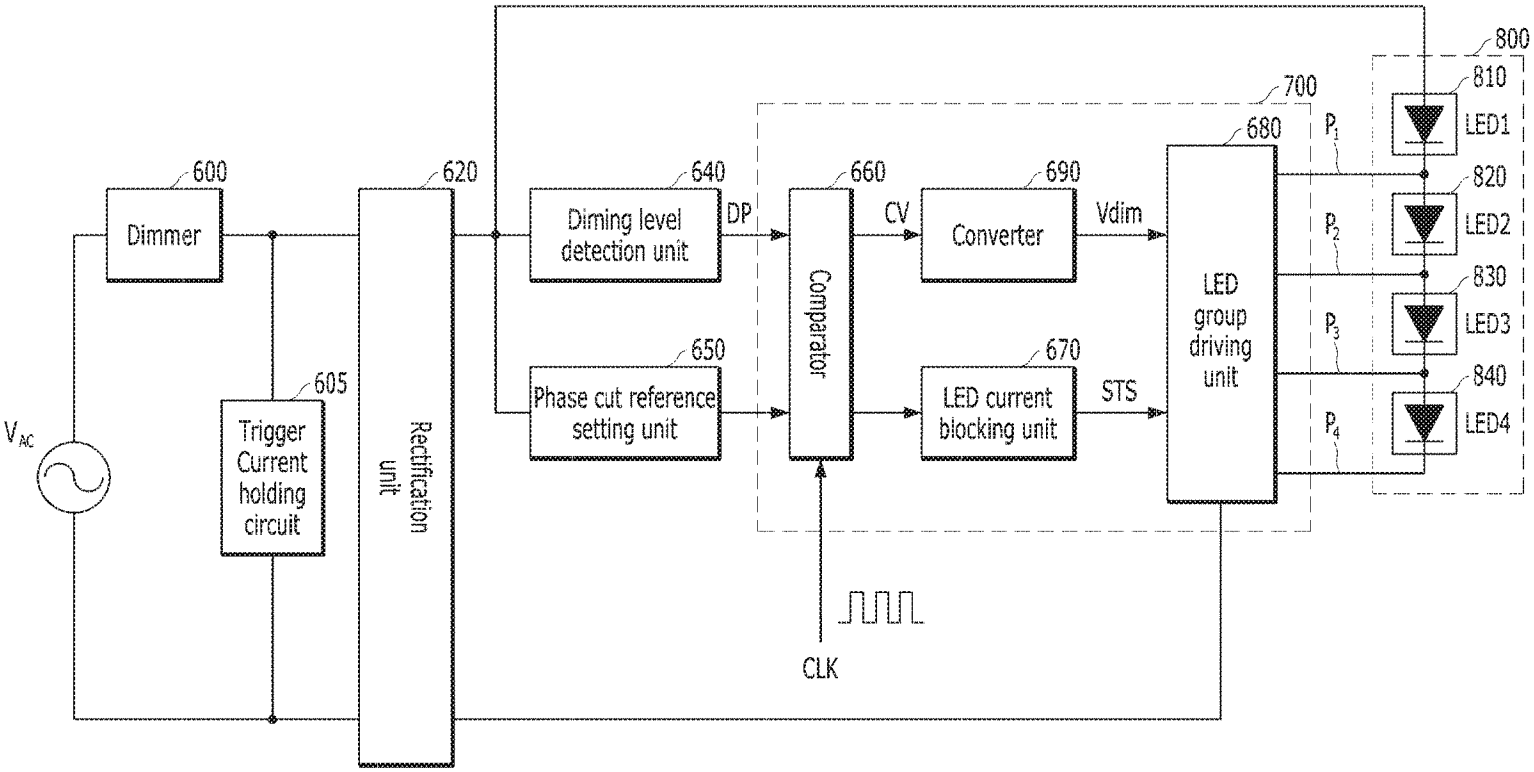
FIG. 7 is a block diagram of an AC-driven LED lighting apparatus according to another exemplary embodiment of the present disclosure.

FIG. 7 is a block diagram of an AC-driven LED lighting apparatus according to another exemplary embodiment of the present disclosure.

Referring to FIG. 7, the lighting apparatus includes a TRIAC dimmer 600, a trigger current holding circuit 605, a rectification unit 620, a dimming level detection unit 640, a phase cut reference setting unit 650, an LED driving module 700, and an LED lighting unit 800.

The TRIAC dimmer 600, the trigger current holding circuit 605, the rectification unit 620, and the LED lighting unit 800 has the same configuration as the TRIAC dimmer 100, the trigger current holding circuit 105, the rectification unit 120, and the LED lighting unit 300, respectively. Therefore, the overlapping description will be omitted to avoid redundancy.

The dimming level detection unit 640 detects a dimming level of a drive voltage, and outputs a dimming phase signal DP, as the detected dimming level, to the LED driving module 700. In an exemplary embodiment, the dimming level detection unit 640 may output the dimming phase signal DP when the drive voltage is higher than a give voltage level (e.g., 0.3V). In this case, the dimming phase signal DP may include information representing a time in which the phase cut drive voltage is provided.

The phase cut reference setting unit 650 outputs a phase cut reference value to the LED driving module 700.

The LED driving module 700 blocks drive currents, which are applied to first to fourth current paths P1 to P4, based on the dimming phase signal DP and the phase cut reference value.

The LED driving module 700 includes a comparator 660, a LED current blocking unit 670, and LED group driving unit 680. The comparator 660 receives the dimming phase signal DP and the phase cut reference value. The comparator 660 compares the dimming phase signal DP and the phase cut reference value and provides the comparison result to the LED current blocking unit 670. In an exemplary embodiment, the comparator 660 may further receive a clock signal CLK, and count pulses of the clock signal CLK which are toggled while the dimming phase signal DP is outputted, and compare the counted value CV to the phase cut reference value. In another exemplary embodiment, the comparison between the counted value CV and the phase cut reference value may be performed by the LED current blocking unit 670. In this embodiment, the LED current blocking unit 670 may receive the counted value CV and the phase cut reference value. The LED current blocking unit 670 enables or disables a stop signal STS according to the comparison result. The LED group driving unit 680 blocks the drive currents applied to the first to fourth current paths P1 to P4 according to the stop signal STS.

In an exemplary embodiment, the LED group driving unit 680 may further receive the dimming voltage Vdim. The LED group driving unit 680 may control the drive current based on the dimming voltage Vdim as described with reference to FIG. 5. In an exemplary embodiment, the LED driving module 700 may further include a converter 690 which converts the counted value CV into the dimming voltage Vdim.

Figure 8:
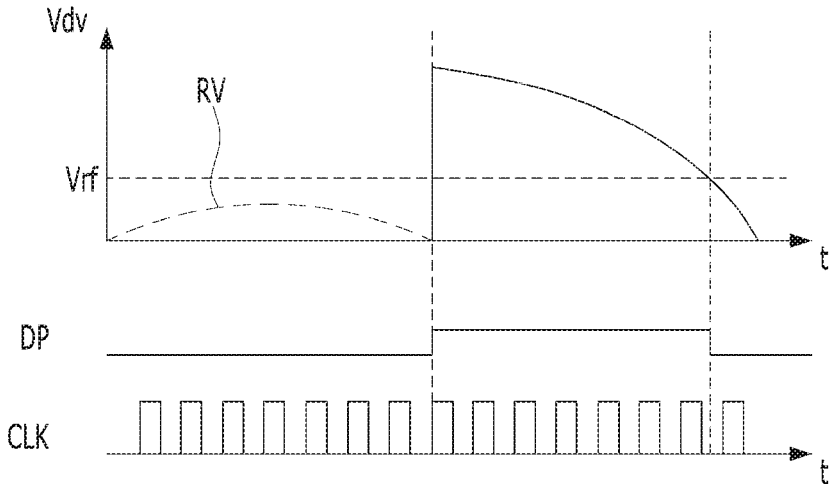
FIG. 8 is a view illustrating a drive voltage and a clock signal.

FIG. 8 is a view illustrating the drive voltage and the clock signal.

Referring to FIG. 8, the drive voltage Vdv is provided from the rectification unit 620. The dimming level is detected based on the drive voltage Vdv. The dimming phase signal DP may be enabled when the level of the drive voltage Vdv is higher than a reference voltage Vrf. For example, the reference voltage Vrf is 0.3V. A time duration in which the dimming phase signal DP is enabled may be associated with a time in which the phase cut drive voltage Vdv is provided. Therefore, the dimming phase signal DP can be provided as the dimming level.

The pulses of the clock signal CLK toggled while the dimming phase signal DP is enabled is counted. In FIG. 8, 7 pulses are toggled while the dimming phase signal DP is enabled.

The number of counted pulses may be compared to the phase cut reference value, and the stop signal may be enabled according to the comparison result. For example, the stop signal STS is disabled when the phase cut reference value is equal to or lower than 7, and the stop signal STS is enabled when the phase cut reference value is higher than 7.

The drive voltage Vdv may have a residual voltage RV corresponding to the noise. The noise may not be reflected in the dimming level when the reference voltage Vrf is set to be higher than the residual voltage RV. Accordingly, the AC-driven LED lighting apparatus according to the exemplary embodiment of the present disclosure detects the dimming level with the high reliability.

Figure 9:
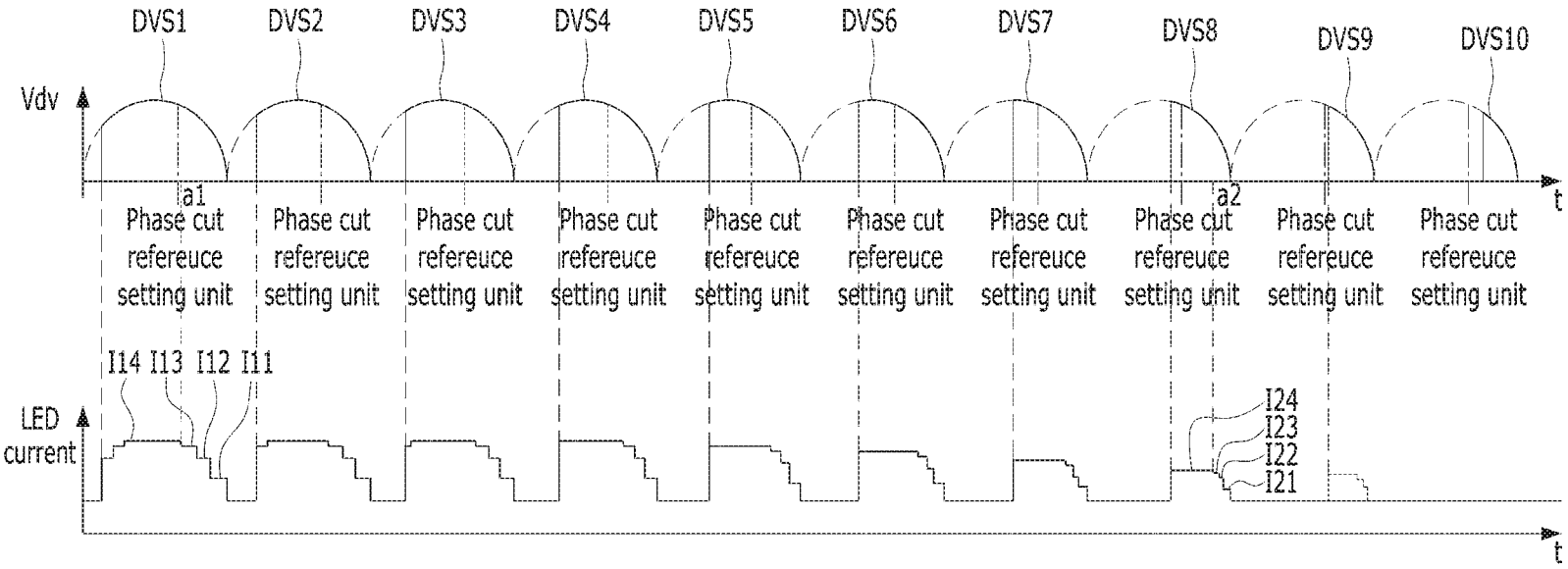
FIG. 9 is a waveform graph illustrating drive currents of LED groups depending on the variation of the dimming level.

FIG. 9 is a waveform graph illustrating drive currents of LED groups depending on the variation of the dimming level.

Referring to FIG. 9, first to ninth voltage signals DVS1 to DVS10 are provided in 10 cycles of the drive voltage, respectively.

In response to the first drive voltage signal DVS1, first to fourth drive currents I11 to I14 are applied to the first to fourth current paths P1 to P4. The fourth drive current I14 is applied to the fourth current path P4, the third drive current I13 lower than the fourth drive current I14 is applied to the third current path P3, the second drive current I12 lower than the third drive current I13 is applied to the second current path P2, and the first drive current I11 lower than the second drive current I12 is applied to the first current path P1.

In response to the second to seventh drive voltage signals DVS2 to DVS7, drive currents are applied to the first to fourth current paths P1 to P4.

In response to eighth drive voltage signal DVS8, first to fourth drive currents I21 to I24 are applied to the first to fourth current paths P1 to P4. The fourth drive current I24 is applied to fourth current path P4, the third drive current I23 lower than the fourth drive current I24 is applied to the third current path P3, the second drive current I22 lower than the third drive current I23 is applied to the second current path P2, and the first drive current I21 lower than the second drive current I22 is applied to the first current path P1.

The drive current is adjusted based on the dimming level. The eight drive voltage signal DVS8 has a lower dimming level than the first drive voltage signal DVS1 as shown in FIG. 9. The drive current I24 is lower than the drive current I14, the drive current I23 is lower than the drive current I13, the drive current I22 is lower than the drive current I12, and the drive current I21 is lower than the drive current I11.

It is well known that the forward voltage of each LED group decreases as the drive current decreases. It means that the number of the LED groups emitting under the same level of the drive voltage increases as the drive current decreases. For example, as the drive current decreases, a time at which the operation mode is changed from the fourth stage driving interval to the third stage driving interval may be delayed. In FIG. 9, a time at which the operation mode is changed from the fourth stage driving interval to the third stage driving interval in response to the first drive voltage signal DVS1 is a first phase a1, a time at which the operation mode is changed from the fourth stage driving interval to the third stage driving interval in response to the eighth drive voltage signal DVS8 is a second phase a2. With reference to each cycle, the second phase a2 is delayed more than the first phase a1. According to the exemplary embodiment of the present disclosure, although the drive voltage signal (e.g., DVS8) does not include the relatively high voltage level due to the low dimming level, the fourth stage driving interval can be effectively secured by controlling the drive current based on the dimming level. Furthermore, the dimming level causing the block for the drive current may decrease by selecting the phase cut reference value with considering a minimum dimming level (e.g., the dimming level corresponding to DVS8) at which the fourth stage driving interval is secured. It means that a range of the dimming levels providing a function of adjusting the quantity of light may become wider.

Meanwhile, the dimming level of the ninth drive voltage signal DVS9 may be lower than the phase cut reference value. The LED driving module 200 and 700 shown in FIGS. 1 and 7 blocks the drive currents. For instance, the block for the drive currents may be performed when the ninth drive voltage signal DVS9 is supplied. For another instance, the drive currents corresponding to the ninth drive voltage signal DVS9 may be provided as shown with a dot line of FIG. 9, and drive currents corresponding to the next drive voltage signal DVS10 may be blocked.

Although certain exemplary embodiments and implementations have been described herein, other embodiments and modifications will be apparent from this description. Accordingly, the inventive concepts are not limited to such embodiments, but rather to the broader scope of the presented claims and various obvious modifications and equivalent arrangements.

What is claimed is:

1. An LED lighting apparatus, comprising:

a rectification circuit configured to rectify a modulated AC voltage to generate a drive voltage;

an LED driving module connected to a plurality of LED groups and configured to apply a drive current to at least one of the plurality of LED groups according to a level of the drive voltage; and a dimming level detector configured to detect a dimming level corresponding to the drive voltage, wherein the LED driving module is configured to compare the detected dimming level to a reference value and block the drive current based on a result of the comparison.

2. The LED lighting apparatus of claim 1, wherein a number of LED groups to which the drive current is applied varies according to the level of the drive voltage.

3. The LED lighting apparatus of claim 2, wherein a cycle of the drive voltage comprises a time period in which all of the plurality of the LED groups are driven when the detected dimming level is equal to or higher than the reference value.

4. The LED lighting apparatus of claim 1, wherein the LED driving module is configured to block the drive current when the detected dimming level is lower than the reference value.

5. The LED lighting apparatus of claim 1, wherein the dimming level detector comprises an integration circuit comprising a resistor and a capacitor.

6. The LED lighting apparatus of claim 1, wherein the LED driving module is configured to decrease the drive current as the level of the drive voltage decreases.

7. The LED lighting apparatus of claim 1, wherein the LED driving module is configured to control the drive current according to the detected dimming level.

8. The LED lighting apparatus of claim 1, wherein:

the plurality of LED groups comprises first to $n^{th}$ LED groups sequentially connected to an input node which receives the drive voltage, wherein n is a positive integer; and the LED driving module is connected to output terminals of the first to $n^{th}$ LED groups through first to $n^{th}$ nodes, respectively.

9. The LED lighting apparatus of claim 8, wherein:

the LED driving module is configured to apply the drive current to $k^{th}$ node selected from the first to $n^{th}$ nodes according to the level of the drive voltage, wherein k is a positive integer equal to or smaller than n; and the drive current is controlled according to the detected dimming level.

10. The LED lighting apparatus of claim 9, wherein the LED driving module decreases the drive current as k decreases.

11. The LED lighting apparatus of claim 1, wherein:

the dimming level detector is configured to output a dimming phase signal when the drive voltage is higher than a predetermined voltage level; and the dimming phase signal is provided as the dimming level.

12. The LED lighting apparatus of claim 11, wherein:

the LED driving module comprises a comparator configured to receive a clock signal and count pulses of the clock signal which are toggled while the dimming phase signal is outputted; and the drive current is blocked based on a number of counted pulses.

13. The LED lighting apparatus of claim 12, wherein the LED driving module further comprises an LED current blocking unit configured to block the drive current when the number of counted pulses is less than the reference value.

14. The LED lighting apparatus of claim 12, wherein:

the LED driving module further comprises a converter configured to output a dimming voltage according to the number of counted pulses; and the drive current is controlled according to the dimming voltage.

* * * * *